United States Patent [19]

Clarke et al.

[11] Patent Number: 4,692,350

[45] Date of Patent: Sep. 8, 1987

[54] ASPHALT COATING METHOD

[75] Inventors: Aubrey R. Clarke, Brighton South; Colin L. Martin, East Kew; Robert H. Bowering, Mount Waverley, all of Australia

[73] Assignee: Mobil Oil Corporation, New York, N.Y.

[21] Appl. No.: 846,840

[22] Filed: Apr. 1, 1986

Related U.S. Application Data

[63] Continuation of Ser. No. 681,062, Dec. 12, 1984, abandoned, which is a continuation of Ser. No. 444,403, Nov. 22, 1982, abandoned, which is a continuation of Ser. No. 153,428, May 27, 1980, which is a continuation of Ser. No. 965,363, Nov. 30, 1978, abandoned, which is a continuation-in-part of Ser. No. 638,243, Dec. 8, 1975, abandoned, said Ser. No. 638,243, is a continuation-in-part of Ser. No. 313,312, Dec. 8, 1972, abandoned, which is a continuation-in-part of Ser. No. 92,771, Nov. 25, 1970, abandoned.

[51] Int. Cl.[4] ..... B05D 5/10; E01C 5/12

[52] U.S. Cl. ..... 427/138; 106/122; 106/277; 106/278; 427/373; 427/427

[58] Field of Search ..... 427/138, 136, 373, 427, 427/443; 404/75, 76; 405/265, 266, 270; 428/489; 47/DIG. 10; 106/277, 178, 177, 122, 86, 53, DIG. 7

[56] References Cited

U.S. PATENT DOCUMENTS

| | | | |
|---|---|---|---|
| 2,283,192 | 5/1942 | Ditto | 106/277 |
| 2,681,321 | 6/1954 | Stastny et al. | 264/53 |
| 2,917,395 | 12/1959 | Csanyi | 106/122 |
| 3,026,272 | 3/1962 | Rubens et al. | 264/53 |
| 3,026,274 | 3/1962 | McMillan et al. | 264/53 |
| 3,268,635 | 8/1966 | Kraus et al. | 264/53 |
| 3,407,151 | 10/1968 | Overcashier et al. | 264/176 R |
| 3,423,222 | 1/1969 | McConnaughay | 106/278 |
| 3,491,032 | 1/1970 | Skochdopole et al. | 264/53 |
| 3,679,783 | 7/1972 | McGarr | 264/53 |
| 3,891,585 | 6/1975 | McDonald | 427/138 |
| 3,912,838 | 10/1975 | Kraus et al. | 427/373 |

FOREIGN PATENT DOCUMENTS

| | | | |
|---|---|---|---|
| 1143318 | 9/1957 | France | 106/122 |

*Primary Examiner*—Sadie L. Childs

*Attorney, Agent, or Firm*—McKillop Alexander J.; Michael G. Gilman; Malcolm D. Keen

[57] ABSTRACT

Substrates such as aggregates, particularly for road-building, are coated with asphalt by foaming the asphalt and mixing the hot asphalt foam with the aggregate. The asphalt is foamed by dispersing water in the hot asphalt as to maintain the water in the liquid phase and then vaporizing the water to form the foam structure.

24 Claims, 13 Drawing Figures

FIG. 1
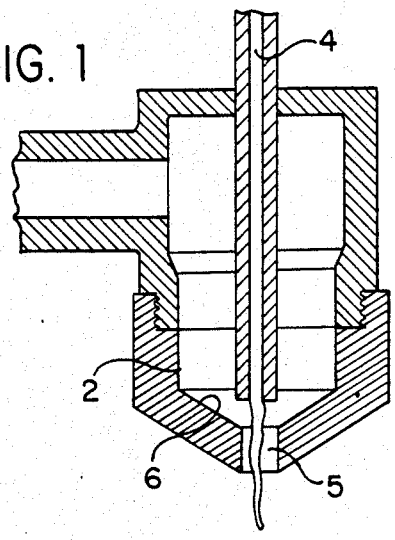
FIG. 2
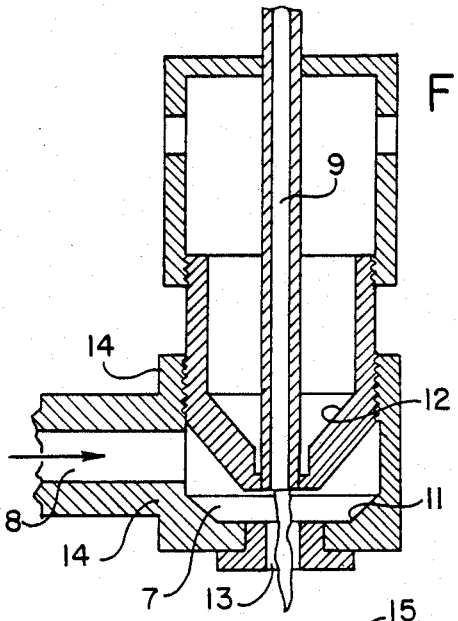
FIG. 3
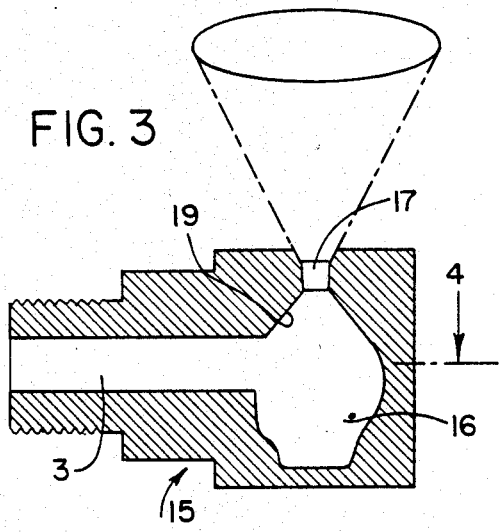
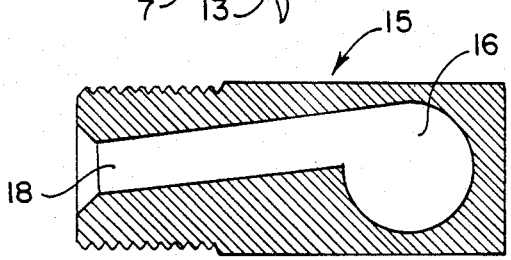
FIG. 4
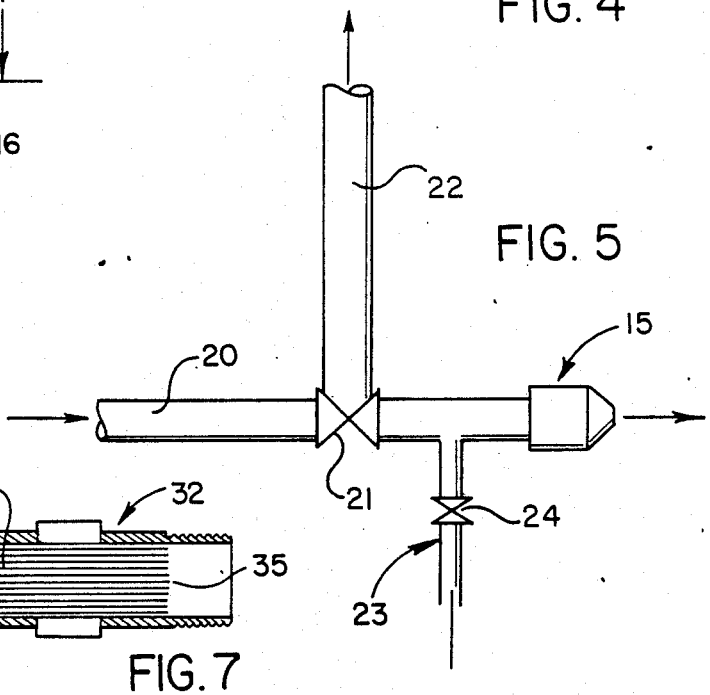
FIG. 5
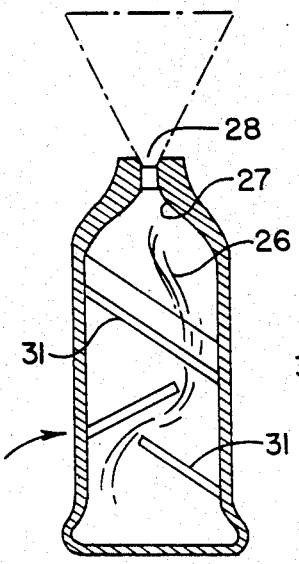
FIG. 6
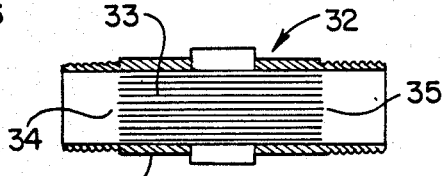
FIG. 7

FIG. 8
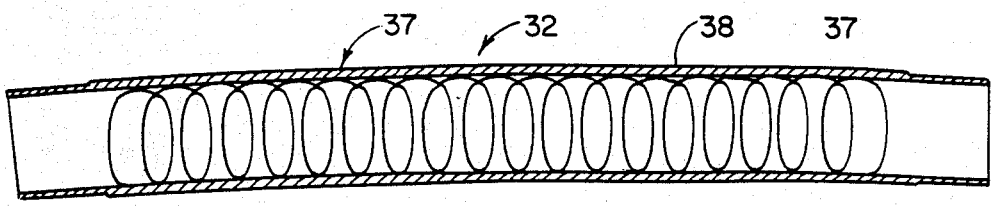
FIG. 9
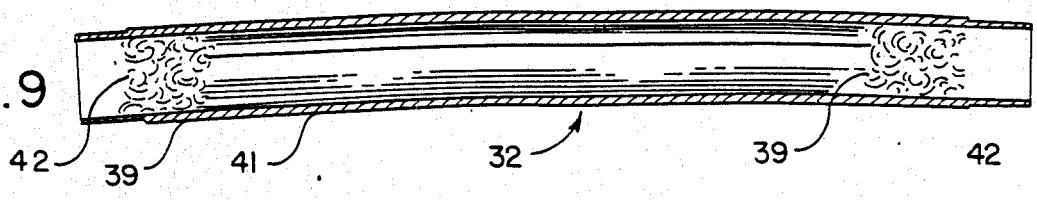
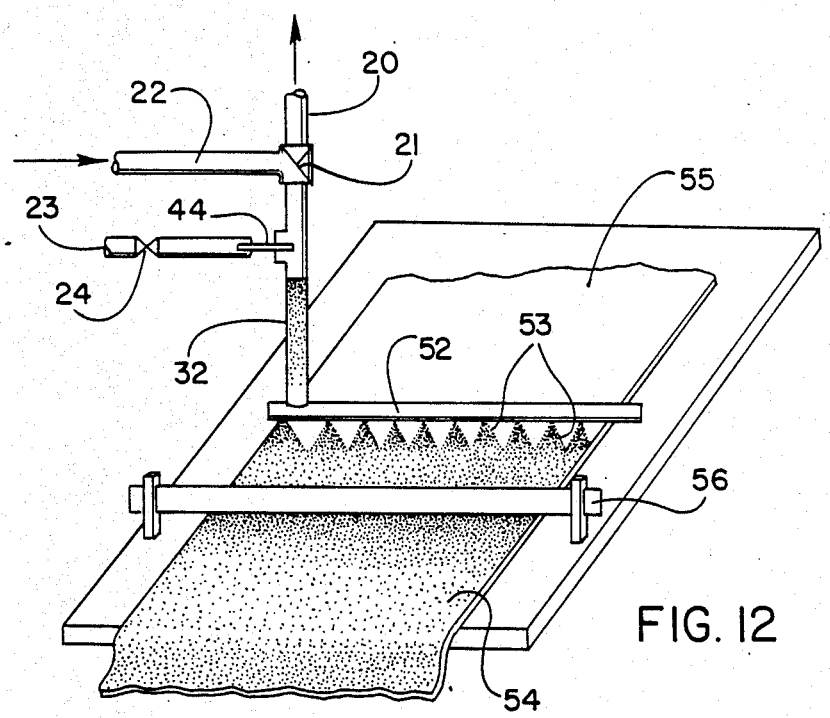
FIG. 12
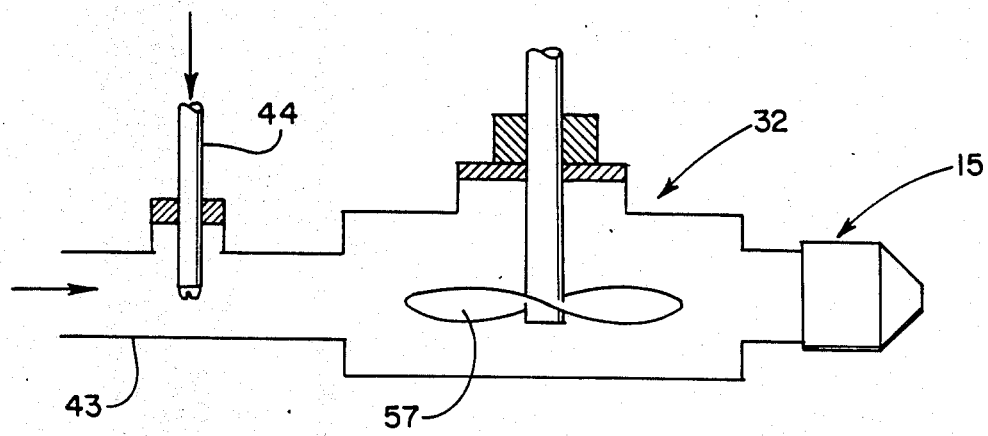
FIG. 13

ASPHALT COATING METHOD

CROSS-REFERENCE TO RELATED APPLICATIONS

This is a continuation of copending application Ser. No. 681,062, filed on Dec. 12, 1984 now abandoned, which is a continuation of application Ser. No. 444,403, filed Nov. 22, 1982 now abandoned, which is a continuation application [37 C.F.R. 1.60] of Ser. No. 153,428, filed May 27, 1980, which, in turn, is a continuation application [37 C.F.R. 1.60] of Ser. No. 965,363, filed Nov. 30, 1978, now abandoned, which in turn, is a continuation-in-part of Ser. No. 638,243, filed Dec. 8, 1975, now abandoned. Application Ser. No. 638,243 was a continution-in-part of Ser. No. 313,312, filed Dec. 8, 1972, now abandoned, which, in turn, was a continuation of Ser. No. 92,771, filed Nov. 25, 1970, now abandoned.

BACKGROUND OF THE INVENTION

1. Field of the Invention

This invention relates to a method of coating substrates, particularly aggregates for road building, with asphalt. It may also be used to coat other materials such as paper, paperboard (corrugated or otherwise).

2. Description of the Prior Art

Asphalt (which is sometimes referred to as "bitumen") has previously been used for coating aggregates which are to be used in road building, for example, for effecting soil stabilisation. The coating may be carried out in a coating plant or in situ, but in either case, it is difficult to mix the asphalt with the solid aggregate except under special conditions and even then, it is difficult to coat the aggregate evenly when it is cold or moist or both. This often causes trouble because road building aggregate is usually stored out of doors where it easily becomes wet and often cold.

Various proposals have been made for solving these problems but all of them up to the present, have been unsatisfactory in one respect or another.

For example, Csanyi in U.S. Pat. No. 2,917,395 proposes the use of an asphalt foam to coat the aggregate. In principle, this proposal has substantial merit because the foam can be spread more easily than the asphalt itself and because the foam occupies a greater volume than the original asphalt it is relatively easy to spread a smaller amount of asphalt on the aggregate, thus effecting a more economical use of the asphalt binder. The asphalt foam is formed by the use of steam which is mixed with the hot, liquid asphalt in a nozzle to form a foam which can then be applied to an aggregate and mixed with it.

The commercial utilization of this method has, however, been retarded because of the relatively poor and inconsistent quality of the foam it produces. Foamed asphalt is well suited for coating and binding aggregate, even when cold and moist, if it is expanded to a volume of at least 10, and generally 15 to 20 or even 50 times or greater than that of the asphalt from which it is formed but lower volumes become increasingly poorer in their ability to be mixed with aggregate. It is common to obtain a foam:asphalt ratio of as low as 2:1 by this steam foaming method, and in practice it is unlikely that the ratio will rise above 4:1. Practical considerations render it extremely difficult, if not impossible, to mix steam into asphalt or any other relatively viscous material, in amounts such that the desired expansion can be achieved. For example, in order to obtain a foam:asphalt volume ratio of 17:1 at a typical working temperature of 280° F., four volumes of steam would be required for each volume of asphalt at a mixing pressure of 4 atmospheres absolute, and incorporation of this amount of steam is hardly practicable in the time allowed and in the equipment used.

A further disadvantage of the steam foaming method is that it requires a source of water which is suitable for steam production. Yet another disadvantage is the practical difficulty of controlling the foaming operation so as to enable selection of a desired foam:asphalt ratio.

Another solution to the problem was proposed in U.S. Pat. No. 3,423,222 by McConnaughay. In this case the method involves heating the aggregate in a drum and coating the hot aggregate with a cloud of the asphalt binder discharged from a nozzle. The liquid asphalt is mixed with water and discharged in the form of a turbulent dispersion or cloud onto the hot aggregate.

The disadvantage of this method is that it relies upon the use of a heater and this greatly increases the costs of the operation particularly when the aggregate must be heated, as recommended, to a temperature of 400° F. at the point of discharge. In addition, the capital cost of the equipment is high. It would be clearly desirable to eliminate the need for heating the aggregate and for avoiding, if possible, the use of expensive equipment.

Ditto U.S. Pat. No. 2,283,192 discloses a method for mixing bituminous cutbacks and other hydrocarbon oils with aggregates such as crushed stone or coal dust by combining water with the hydrocarbon oil in a colloid mill under pressure. The hydrocarbon oil may be heated prior to being mixed with the water and, if necessary, the emulsion can be heated in the mill. After the water-/oil emulsion has been formed it can be subjected to further heating or cooling if desired. The emulsion is then discharged to the atmosphere through a nozzle to form a foam which is applied to the aggregate and mixed with it.

There are a number of disadvantages to the Ditto process. First, it relies upon the use of a mechanical colloid mill to form the emulsion. We have found that the use of such mills is undesirable not only because they are difficult to maintain—especially when attempts are made to employ high melting point asphalts in the process—but also because they produce very fine dispersions which have to be kept under considerable pressure to prevent the water evaporating. When asphalt is used, as the hydrocarbon medium, it generally requires to be at a relatively high temperature; when the water is dispersed into this hot asphalt by the colloid mill the heat transfer to the small water droplets is extremely fast and tends to cause premature evaporation of the water unless the entire system is maintained under a high pressure. This is generally undesirable because the equipment becomes bulky, heavy and costly and the process more difficult to control and operate. In addition, the Ditto process is inefficient in its use of heat: heat may be added to the system after the emulsion is formed, thus compounding the premature evaporation problem or, alternatively, if the action of the mill generates excessive heat—as it frequently does—the emulsion must be cooled, making it less thermally efficient.

It would be desirable to devise a process which is more thermally efficient than the Ditto process and which, moreover, does not require the use of expensive equipment such as colloid mills and pressure vessels.

SUMMARY OF THE INVENTION

We have now devised a method for coating aggregates with asphalt binders which is inexpensive and which does not require the aggregate to be dried or heated. In fact, one of the principal advantages of the method is that it enables many kinds of cold, moist aggregate to be coated effectively with asphalt. Furthermore, the method is readily controllable: although it relies upon the production of an asphalt foam the foam ratio can be accurately and easily controlled. If the method is used to coat an aggregate mixture of fine material and larger stones, the effect of the process is to coat the fines preferentially. Surprisingly, this provides a mixture with more desirable properties than would be obtained if all the particles were evenly coated. A further advantage of the present process is that it is highly efficient in its use of heat. The asphalt can be used in the process at about the same temperature that it is normally stored and transported and no additional heating or cooling is necessary because the process is operated in a mode which conserves thermal energy as much as possible. In addition, the process requires only relatively simple, rugged equipment which can be easily maintained even in remote areas.

Although the invention will be described below with particular reference to coating aggregates it is useful for coating other substrates or impregnating them with asphalt, for example, paper, boards, carpet backing, metal plates and structural members. In each case, the method enables a coherent, even coat to be applied.

The method involves dispersing a volatile liquid foaming agent in the liquid asphaltic base material so that the foaming agent is maintained in the liquid state. A fine dispersion of the two materials is formed so that when the mixture is discharged (by passing it through a nozzle), an even foam structure is produced.

After being discharged, the foam structure begins to collapse but since the hot foam is discharged straightaway onto the aggregate, it can immediately be mixed with the aggregate (or spread on another substrate) while still in the foamed condition. The life of the foam can be expressed by the half-life, that is, the time taken for the volume of the foam to fall to one-half its original value. Half-lives of about 2.5 minutes are typical, depending upon the foam:asphalt ratio in use.

The method may be operated continuously by injecting the aqueous liquid foaming agent into a stream of liquid asphaltic base material. Since the foaming agent is insoluble in the asphalt base material a dispersion is formed and it is desirable that this dispersion should be sufficiently fine to ensure rapid and substantially complete vaporisation as the water/asphalt mixture leaves the discharge nozzle.

BRIEF DESCRIPTION OF THE DRAWINGS

The accompanying drawings illustrate certain preferred forms of apparatus for carrying out the method. These are given by way of illustration only. In the drawings:

FIG. 1 is a diagrammatic section of a foam-forming nozzle;

FIG. 2 is a modified form of the nozzle shown in FIG. 1;

FIG. 3 is a diagrammatic section of another foam-forming nozzle;

FIG. 4 is a cross-sectional view taken along line 4—4 of FIG. 3;

FIG. 5 is a diagrammatic view of part of a foam-generating system including a nozzle such as that shown in FIG. 3;

FIG. 6 is a diagrammatic section of part of another nozzle suitable for use in the system of FIG. 5;

FIG. 7 is a diagrammatic view of a premixing device suitable for use with the nozzle of FIG. 3 or FIG. 6;

FIG. 8 is a diagrammatic view of an alternative premixing device;

FIG. 9 is a diagrammatic view of another premixing device;

FIG. 12 is a diagrammatic view of an arrangement employing a spray bar; and

FIG. 13 is a diagrammatic view of another premixing device with a movable mixing element.

MATERIALS

1. Asphaltic Base Material

Figure 10:
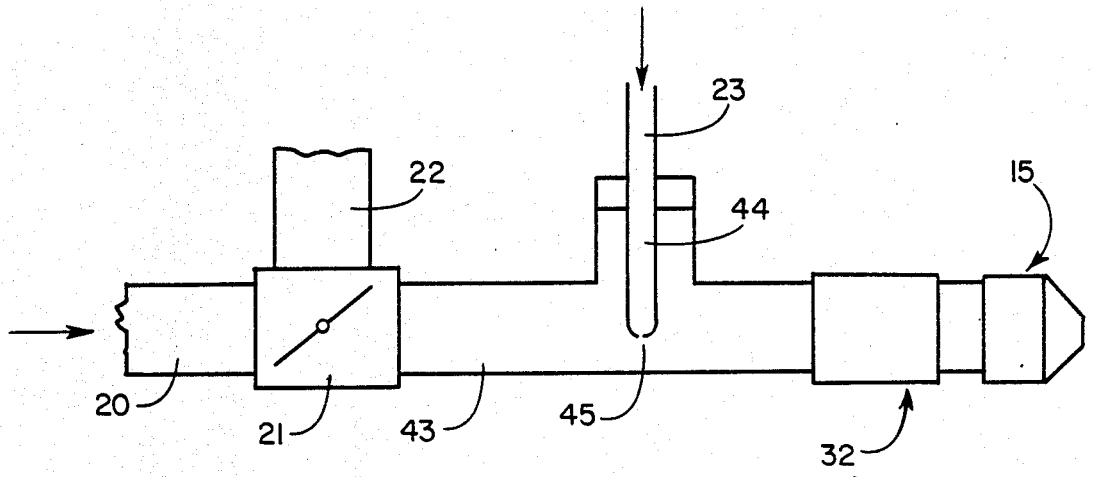
FIG. 10 is a diagrammatic view of part of a circuit including a premixing device according to any one of FIGS. 7 to 9, and a nozzle according to FIG. 3 or FIG. 6.

The asphaltic base material which is used comprises an asphalt, optionally blended with other ingredients, as will be described below. Asphalts are sometimes referred to as "bitumens".

Asphalts belong to the general class of bituminous materials and may be defined as black-to-brown solid or semi-solid cementitious materials which gradually liquefy when heated and in which the predominating constituents are bitumens. They are obtained in the United States mainly from the refining of petroleum and in this case are referred to as petroleum asphalts although they may also be of natural origin. Petroleum asphalts may be produced by distillation of asphaltic crudes, from the residues of solvent extraction or by light hydrocarbon precipitation. They may be air-blown or otherwise treated to modify their properties. Air-blown asphalts, which are normally produced by blowing air through a residual oil at 400° to 600° F., have a variety of uses in coating applications.

The preferred asphalts used in the process are paving grade asphalts, also known as asphalt cements or penetration grade asphalts. These materials are semi-solid at normal temperatures and are used mainly as the binder in asphaltic concretes for highway paving. Paving grade asphalts are defined by reference to their Penetration, as determined by the ASTM D-5 test. The D-5 test measures the penetration of a specified needle into a sample of the asphalt under a specified load, at a specified temperature for a specified period of time. In the ASTM Standard Specification for paving grade asphalt, the penetration is to be measured at 77° F. (25° C.) under a 100 gram load for 5 seconds. Under these conditions, a paving grade asphalt will have a penetration from 40 to 300 (units of penetration are 0.1 mm.). Five penetration grades are established for paving grade asphalts namely, 40 to 50, 60 to 70, 85 to 100, 120 to 150 and 200 to 300. These are the preferred materials for use in the present process, especially of course for coating aggregates to be used for road building purposes.

The standard specification for paving grade asphalts established by the American Association of State Highway and Transportation Officials (AASHTO) follows the ASTM Standard and the AASHTO T-49 penetration test follows the ASTM D-5 test.

The principal advantage of the present process is that it enables asphalts to be coated readily on aggregates without the use of cutbacks, i.e. solvent diluents such as naphtha or kerosene. This avoids the hazards attendant upon the use of such diluents and enables the curing time to be substantially reduced. Nevertheless, if it is desired to use a cutback asphalt, this is possibla, as demonstrated by the experiments reported later in this specification. The use of cutback asphalts may, for example, be desirable in maintenance mixes for patching.

Other asphaltic materials may also be employed in the process provided they form a foam structure which will persist long enough for the coating procedure to be completed. Such materials include air-blown asphalts, industrial asphalt cements, saturants, mopping asphalts, oxidized industrial fluxes, high P.I. fluxes and the like.

The base material will generally be a liquid when discharged through the nozzle, this liquid having a viscosity of 10 cp or higher at the discharge temperature when measured by a Brookfield viscometer using a No. 1 spindle and rotational speed of 20 r.p.m. It is possible however, that under some circumstances the process may be satisfactorily and advantageously applied to liquids having lower viscosities.

2. Liquid Foaming Agent

The liquid foaming agent is selected on the basis of the following criteria:

1. A boiling point substantially below the desired working temperature for the asphalt. This temperature is selected to obtain a suitable operating viscosity and to ensure effective application of the foam generated to the material being treated.

2. The ability to generate a relatively high ratio of vapor to the original liquid when heated above its boiling point. This requires a relatively low molecular weight.

3. Substantial insolubility, i.e. immiscibility with the liquid asphalt material, so that a dispersion is formed.

The preferred foaming agent comprises water since, although other materials such as lower alcohols (methanol, ethanol, n-or-isopropanol) may be used they are generally more expensive and less safe. In addition, water also has the advantage that a minimal quantity is needed to generate the desired volume of foam. Also, it has a relatively high specific heat and latent heat of evaporation and these features make it easier to avoid premature vaporization, particularly at temperatures above 300° F. Furthermore, the foam generation is assisted by the low solubility of the water in asphalt.

The water which is added to the liquid asphalt may contain additives for altering the properties of the asphalt for controlling the foam generation or for modifying the surface properties of the aggregate. For example, the water may be introduced in the form of an emulsion, e.g. an inverted emulsion of water dispersed in asphalt, oil, tar or another liquid. This other liquid may be soluble in the asphalt. The use of an inverted (i.e. water-in-oil type) emulsion has the advantage of simplifying the dispersing of the water in the hot asphalt because the water has been broken up into droplets of suitable controlled size in the manufacture of the emulsion, and consequently it is then only necessary to ensure mixing of the emulsion and the asphalt which can be expected to occur quite readily, particularly if the continuous phase of the emulsion is miscible with the liquid asphalt. However, if an adequate dispersing action is provided, a non-inverted emulsion (an emulsion in which the water is the continuous phase) may be employed, and in this case the dispersed phase may contain an additive or conditioner for the asphalt.

While coarse inverted emulsions may be used, they have only a limited advantage in simplifying the dispersion requirements of a foam producing system. The most useful emulsions are those with dispersed water particles having a size corresponding to a spherical diameter in the range of from 0.1 to 500 microns, although inverted emulsions having a particle size falling outside this range are also useful.

GENERAL PROCESS CONDITIONS

The asphalt is heated to a temperature above the boiling point of the foaming agent so that the foaming agent will readily evaporate when the mixture is discharged, to form the desired foam structure. It is generally preferred that the temperature of the asphalt should be at least 2° F. higher than the boiling point of the foaming agent at the pressure of the discharge zone. The maximum temperature is limited by several factors including the decomposition temperature of the asphalt and consequently may vary over a relatively wide range, but 600° F. may be considered a typical maximum temperature. Generally, the asphalt will be brought to a temperature from 240° F. to 350° F., preferably 330° to 350° F. in order to render it readily flowable.

At these high temperatures (e.g. asphalt at 325° F.) various physical properties become adverse to foam generation. Thus, viscosity becomes relatively low and substantially Newtonian—for example a 90 penetration road grade will typically have a viscosity of 4 Stokes at 275° F. It is known from general foam theory and practice that the factors that produce naturally short lived foams also cause foam generation to be difficult, and it has been found that short life is a characteristic of foams generated from asphalt at high temperatures. This is well illustrated by the observations made in Examples 2 and 3 below where the half lives of the water generated foams were 1 and 1.5 minutes respectively. At the same time, it is essential for many purposes that the foams be generated on a highly expanded scale instantaneously upon exit from the nozzle. This is because the temperature drop becomes too great if the jet of foam is allowed to travel too far through the air. Apart from the fact that cooling of the steam inside the foam bubbles causes the foam to contract and then collapse when condensation occurs, it is generally necessary to conserve heat within the foam so as to provide the most favorable conditions for mixing with cold aggregate. In fact, in some cases proper mixing cannot be obtained unless the nozzle outlet is placed almost in contact with the material being treated.

Another advantage of instantaneous foam production is that this permits close control of the area being treated, for example, when applying foams to moving sheets of material.

Water:asphalt ratios are normally within the range from 1:1 to 1:2000 (by weight) are preferred although useful foams can also be obtained with weight ratios outside that range. Ratios of from 1:5 to 1:150 (water:asphalt) are generally used for best results; ratios of 0.03:1 (1:33) to 0.01:1 (1:100), usually about 0.02:1 (1:50) are normally found to give good results. A ratio of 1:100 by weight has resulted in a 16:1 foam:asphalt volume ratio, which is particularly suitable for use as an aggregate binder. In order to obtain a foam:asphalt volume ratio within the range of 15:1 to 20:1, (referred to a temperature of approximately 250° F.), the minimum ratio has been found to be approximately 1 volume of water to 100 volumes of asphalt.

The water is dispersed in the asphalt under adiabatic conditions in the dispersion zone, that is, heat is neither deliberately added to or removed from the dispersion zone. Furthermore, the adiabatic conditions are maintained after the water has been dispersed in the asphalt so that the heat which is transferred to the dispersed water droplets is derived entirely from the hot asphalt: no external heating is either necessary or desirable. The heat content of the dispersion so formed is sufficient to vaporize the dispersed foaming agent under the atmospheric conditions prevailing after discharge, so that no external heat needs to be supplied. The fact that the process is operated in this way makes it extremely thermally efficient. It should, of course, be understood that heat may be lost from or added to the system by reason of the temperature differentials with respect to the surrounding atmosphere. Such losses or additions (which are unavoidable although they can be mitigated by insulation) are not considered to detract from the substantially abiabatic conditions under which the dispersion is formed and maintained until it is discharged to form the foam.

Because the water is vaporized by direct contact with the hot asphalt, it may be obtained from less pure sources than are required for steam production. This is an advantage of road building in areas where supplies of pure water are scarce. However, if the water is used in combination with steam (as will be described later) the water may be produced by a condenser located in the steam line so that a suitable volume of water is continuously extracted from the steam supply. Preferably, however, the water and steam are fed from independent supplies.

As the water is insoluble in the liquid asphalt it forms a fine dispersion under the mixing conditions employed in the process and when the finely-dispersed droplets evaporate they expand to form the foam structure. The droplets of water evaporate through transfer of heat from the asphalt and this is a time dependant process. Increasing the droplet size results in a longer time to evaporate. Since the evaporation should normally be substantially complete at or just after discharge the droplet size should be matched to the time taken for the moving stream to travel from the dispersing zone to the discharge point, the asphalt temperature and other relevant factors. If the droplets are too large, the discharged stream may reach the substrate before adequate foam formation has taken place. On the other hand, excessively small droplets may heat up so rapidly that they flash off as free steam within the foam producing device. Generally, particle size for the dispersed droplets is expected to be within the range 0.1 to 500 microns, more generally 2 to 20 microns.

The pressure on the dispersion is chosen so as to provide the desired flow rate, flow velocity and the desired discharge pattern for the foam. In addition, the pressure may be adjusted to reduce vaporisation of the liquid droplets prior to discharge. However, it is not essential for the pressure to be maintained at a value sufficient of itself to maintain the droplets in the liquid phase; in fact, the process can be operated almost at atmospheric pressure if this is desired. The use of higher pressures is an option which may be employed where delayed evaporation of the liquid droplets would be advantageous. In this case, the evaporation of the droplets will occur most readily when the pressure is released.

The foam ratio may be varied according to the intended application and the present method allows a relatively high degree of control to be exercised over the quality of the foam produced, in terms of its stability and uniformity. Although a foam:asphalt volume ratio of 20:1 is a satisfactory upper limit for use in coating aggregate, higher ratios may be used and may be desirable in some applications although ratios exceeding 20:1 do not normally possess any marked advantage and sometimes show reduced foam stability.

Foam ratios of 10:1 or more are usually preferred in most applications, but there are some applications such as in coating sheets of material where foam ratios as low as 2:1 may be useful. Low volume foams of this type can be developed reliably, with freedom from atomized base material, and without a high velocity discharge where that is undesirable. Such low ratio foams can readily be produced by reducing the ratio of volatile liquid foaming agent to asphalt, for example, where this may be reduced to 1 to 2000 parts by volume.

Another useful feature of the method is that it permits control over the texture of the foam (bubble dimensions and uniformity of bubble size). These are of practical importance in that coarser foams generally have a shorter life (other variables being held constant) and this may be a disadvantage or advantage according to the use to which the foam is being put. Also the finer foams may be better suited to penetration of small apertures, and they afford the highest surface area; this is useful for obtaining maximum coverage in a coating application.

Bubble size can be increased and foam life decreased by using larger amounts of foaming agent (water). It can also be controlled by varying the size of the dispersed water droplets. For example when increasing the ratio of water to asphalt from 1:100 to 1:50 in various experiments, foam life was approximately halved. This was judged by the time required for a filled container of 2700 ml capacity to subside to half its volume, typical times being 2.5 and 1.3 minutes, respectively.

A major virtue of the conversion of the asphalt to the foamed condition is that this makes it possible to apply it more effectively or conveniently to many kinds of materials. Depending on the particular application and on the asphalt being foamed, the viscosity at which the use of foam becomes advantageous will vary. In general, the higher viscosity of the molten asphalt, the more likely it is to be attractive to foam it. At the same time, a relatively low viscosity in the molten asphalt makes foam generation difficult so there tends to be a viscosity level at which foaming becomes both advantageous and feasible. It should be noted however that our experiments show that while for one particular kind of material, reducing viscosity below a certain level results in progressively poorer foamability, changing the nature of the material may widely alter the viscosity level at which parallel effects occur.

For example, a sample of paving grade asphalt (Australian R90 Standard Bitumen) having a viscosity of 140 cp at the working temperature of 320° F. gave a foam expansion ratio of 19:1 when injecting 1% of water through a steam assisted nozzle. It was possible to reduce the viscosity of this material by fluxing with a heavy oil without substantial reduction in this expansion ratio, even when the viscosity of the asphalt/oil mixture fell below that of the softest normal paving grade asphalt i.e. one of 200 penetration at 77° F. However, a further progressive reduction in the viscosity (measured at the foaming temperature of 320° F.) caused an accelerating reduction in foam ratio. For example this was reduced to 10:1 at a viscosity of 23 cp at 320° F. This is still a useful foam.

The minimum viscosity for production of foam cannot be defined as a single quantity since it will vary with the foam expansion ratio desired, the working temperature and the composition of the asphalt being foamed.

The minimum acceptable foam expansion ratio will depend very much on the kind of application for which it is to be used. For example in soil stabilization and other jobs requiring admixture of a highly viscous asphalt with cold, fine aggregate, it is generally advantageous to have a highly expanded foam with a 15 to 20 fold volumetric foam ratio. Where the asphalt being foamed is relatively low in viscosity or the material being treated is warm or hot, the foam ratio may not need to be so high. The same is true when applying relatively heavy applications of asphalt to larger objects. In cases where it is desired to limit foam expansion to an intermediate level for a material which is otherwise capable of high expansion, this may readily be achieved, for example, by controlling ratio of water to asphalt.

The requirements for reliably producing substantially instantaneous highly expanded foams from hot asphalt, using water as the foaming agent with adequate control over foam quality and its projection are as follows:

(1) A supply of hot asphalt at a controlled rate to a suitable mixer.

(2) A supply of water delivered at a controlled rate to the mixer, the rate of flow of water relative to bitumen being at least equal to the minimum necessary to generate the desired amount of foam at the desired temperature.

(3) The temperature of the asphalt is sufficient to contain enough heat to vaporize at least the amount of water used and to provide the desired final foam temperature. This temperature is substantially in excess of the condensation temperature of the steam within the expanded foam and in particular high enough to maintain suitable fluidity during the mixing or coating process for which the foam is being used.

(4) The mixer is a device which will achieve controlled dispersion of the water throughout the asphalt. In the dispersion the water is broken up into small enough particles to provide bubbles of satisfactory size on vaporization. At the same time the temperature of the water is rapidly raised to a point where substantially instantaneous development of the foam is achieved when released from the outlet of the foam system, but the water particles should not be so fine as to generate free vapor prematurely.

(5) The flow velocities of the asphalt and water, and steam or gas carrier when used, are adjusted to provide the required exit velocity of foam so as to facilitate its projection onto or into the materials being treated.

As stated above, the dispersion of water droplets in the asphalt should be sufficiently fine to ensure ready generation of foam when the mixture is discharged. On the other hand, it has been found that if dispersion of the water becomes too fine for the system and operating conditions, flashing-off of steam may take place and this is thought to be due to premature vaporization of water within the foam generating equipment or at discharge (See Example 5 below).

Although the present method relies upon the use of water to form the foam, an agent may be introduced into the asphalt together with the water to assist in achieving proper mixing or dispersion of the water throughout the asphalt, or both. It will be convenient to refer to those agents as dispersing agents, and in one form such an agent is formed by a pressurized gas or vapor. By way of example, steam under pressure, compressed air, nitrogen, and flue gas, are possible dispersing agents, and factors such as corrosiveness and toxicity may be considered in selecting a suitable dispersing agent. The dispersing agent may be hot or cold depending on its composition and the conditions under which the process is carried out.

Generally, the principal role of the dispersing agent is to break the water into fine droplets of appropriate size and disperse these droplets throughout the liquid asphalt. In addition, the dispersing agent may also provide directional control and imparts momentum to the subsequently formed foam, thereby facilitating its application to a surface or article to be coated. When steam is used as the dispersing agent, it has been found that introduction of substantially equal weights of steam and water into the bitumen produces satisfactory results.

Apparatus and Special Process Conditions

The following portion of the description refers in more detail to the apparatus which may be used to generate the foam and to process conditions applicable to the use of this apparatus. These details are given by way of example only.

Depending upon the materials and conditions used, various types of apparatus may be used to obtain the best results. Two types of nozzle may be used, as appropriate. One type of nozzle contributes a significant part of the dispersing action, and the other type is usually of simple internal configuration and is used mainly to control the direction, shape and/or velocity of the issuing foam.

The foaming agent may be dispersed in the asphalt either with or without mechanical mixing. Generally it is preferred to avoid the use of mechanical mixing because the mixing apparatus is more complicated and difficult to maintain. By suitable design and construction of the dispersing zone satisfactory dispersions of the foaming agent in the molten asphalt can be produced.

The pressurized dispersing agent method may utilize a mixing nozzle as shown in FIG. 1, which is similar to nozzles used in the steam foaming process for asphalt. In this case, both the steam and the water are introduced through a common passage which serves as the steam passage in the steam-foaming method. Such a nozzle includes a mixing chamber 2 in which streams of bitumen 3 and water-steam 4 respectively travel in substantially the same direction to converge and mix adjacent a discharge orifice 5. The resultant mixture passes through orifice 5 to produce a foam. It is thought that final dispersion of the water within the bitumen 3 occurs in the orifice 5, so that a suitable foam is produced on release of the mix from the nozzle. Usually, the end face 6 of the mixing chamber 2 through which the orifice 5 is formed, is of substantially frusto-conical shape.

A modified nozzle as shown in FIG. 2 is preferably employed and this nozzle includes a mixing chamber 7 and asphalt and water passages 8 and 9 respectively, entering that chamber in directions extending transverse to one another. The dispersing agent preferably enters the mixing chamber 7 through the water passage 9, but may enter through a separate passage if so desired. In one form, the mixing chamber 7 is substantially cylindrical and has substantially frusto-conical opposed end surfaces 11 and 12 which slope in the same direction. A discharge orifice 13 is formed axially through the end surface 11, and the water-steam passage 9 may enter the chamber 7 through the other end surface 12 in substantial alignment with the discharge orifice 13. The asphalt passage 8 enters the chamber 7 through a side wall 14 so that in use, the streams of liquid asphalt and water-steam merge at a zone adjacent the discharge orifice 13. Proper dispersion is then completed during passage of the fluids through the discharge orifice.

Nozzles of the preferred type described above, avoid a relatively long asphalt passage in contact with the water-steam passage (as is the case with the nozzle of FIG. 1) and consequently there is less likelihood of fouling when the water or dispersing agent is cold.

According to an alternative method of producing the foam, the water, or other foam producing agent, alone, is introduced into the liquid asphalt. The desired dispersion may be effected through a device having a configuration or orifice arrangement or both which effects the desired shearing and mixing of the water within a chamber leading to a discharge orifice. Naturally, the water is required to be fed under suitable line pressure.

A mixing device for use in this method includes a nozzle 15 as shown in FIGS. 3 and 4, with a substantially cylindrical mixing chamber 16, a substantially axial discharge orifice 17 formed through one end of the mixing chamber 16 and a material supply passage 18 entering tangentially through a side wall of the chamber 16. Preferably, the supply passage 18 enters chamber 16 approximately midway in the axial length, with the end surface 19 of the chamber 16 through which the discharge orifice 17 passes frusto-conical. The discharge orifice 17 may have a relatively large diameter—e.g. 0.25 to 0.5 inch although sizes outside that range may also be suitable. Such orifices have the advantage of minimizing blockages. In use, streams of bitumen and water are introduced together into the supply passage 18, and thorough mixing of these materials is effected within the mixing chamber 16 as a result of the relationship between supply passage 18 and chamber 16 and by proper control of the fluid velocities.

An example of a foam-generating system incorporating a nozzle 5 is shown diagrammatically in FIG. 5. Asphalt is fed to the nozzle 15 through conduit 20 and valve 21 which is operable to divert the bitumen to a by-pass line 22. Water is fed to nozzle 15 through conduit 23 via a metering valve 24. The metering valve 24 can be operated to control the rate of introduction of the water into the asphalt stream, and the by-pass valve 21 can be operated to allow recirculation of some of the asphalt or all the asphalt flow when nozzle 15 is not being operated.

In a typical test employing this system, asphalt (Australian Standard A1O - 1967 Class R90 Bitumen) was fed at a flow rate of approximately 1 to 1.5 gallons per minute to merge with a water stream having a flow rate of apprcximately 0.01 to 0.03 gallons per minute. The asphalt temperature was held generally within the range 330° to 350° F., and the water was at ambient temperature. Thus, the water:bitumen ratio was within the range 1:50 to 1:100 and a satisfactory foam was produced having a volume approximately 18 times that of the asphalt from which it was formed.

Another arrangement for generating the foam without a pressurized dispersing agent may be as shown in FIG. 6. The mixing device nozzle 15 has an elongate, substantially cylindrical mixing chamber 26 with a frusto-conical end surface 27 and a discharge orifice 28. The supply passage 29 enters the mixing chamber 26 axially through the end opposite to that containing the discharge orifice 28. Suitable vanes 31 are located within chamber 26 to impart a swirling motion to material passing from supply passage 29 towards discharge orifice 28. Such an arrangement generally produces a full cone spray. In a test under conditions substantially as outlined in relation to the first described embodiment, this was found to produce a foam:asphalt volume ratio of approximately 20:1, and the foam production was generally found to be faster upon leaving the nozzle than that achieved with the device first described for use without a pressurized dispersing agent.

Still greater control in the use of foaming agent can be achieved by preceding either of the previously described nozzles 15 by a premixing device having a chamber containing static or moving elements which perform a regulated degree of predispersion before the asphalt/water mixture enters the nozzle. Some such premixing devices are capable of dispersing the water so thoroughly that nothing other than an elementary discharge nozzle or orifice is needed. Also, such premixing devices facilitate the use of foam "spray bars" which in their simplest form are comprised of straight, curved or gridlike lengths of piping perforated with discharge holes at suitable intervals and into which the hot asphalt with the dispersed water is fed from one or more premixing devices. Such spray bars are of special value for coating moving sheets of material for such purposes as surface finishing, bonding, corrosion protection and water proofing, and they are suited to applying asphalt to soils and other road construction materials.

In general, static premixing devices comprise at least one chamber or passage containing convolutions, constrictions, baffles or packing materials, the detailed design specifications for which can usually be best determined by considering variables such as the temperature of operation, the nature of the material being foamed and its critical physical properties such as viscosity, and the flow rate, the desired type of discharge nozzle or spray bar, and the amount and kind of foam producing liquid being used. Exemplary premixing devices are shown in diagrammatic form in FIGS. 7 to 9, and in each of these cases the device is of the static type.

FIG. 7 illustrates a premixing device 32 which includes a spiral packing 33 composed of metal gauze, and transverse end walls 34 and 35 also made of metal gauze and located at respective ends of the packing 33. Preferably, each turn of the spiral packing 33 is substantially equally spaced, and the outer turn fits snugly against the surrounding conduit wall 36. The outer turn may be secured to the wall 6.

According to FIG. 8, the device 32 includes a helical element 37, preferably made of metal, located snugly within a cylindrical conduit section 38. It is preferred that the convolutions of the element are substantially equally spaced.

FIG. 9 illustrates a premixing device 32 having a plurality of Raschig rings 39 disposed within a conduit section 41 and retained in position by spaced transverse walls 42 which are of metal gauze or other perforated structure to allow the passage of liquid. This particular arrangement has been found highly successful in practice; good foams can be obtained without the use of a nozzle, although a simple nozzle or orifice is usually desirable to facilitate control of direction, velocity and spatial pattern of the issuing foam. In fact, under some circumstances, the use of a high shear nozzle with a premixing device according to FIG. 9 may destroy the developing foam or reduce the water particles to an excessively fine state.

The purpose of the packing in the pre-mixing devices is to break up the stream of water into droplets of the desired size by shearing action. This may be caused by turbulence, by change of direction of the flowing liquid, or by passage of the liquid through constricted channels. At the same the dispersed liquid is mixed uniform1y through the liquid asphalt. This should be accomplished without an excessive residence time which might result in significant generation of a free vapor phase. Also the internal pressure drop in the device should not be great enough relative to the inlet pressure to permit the premature vaporization of the water with accompanied premature foam production. This principle applies, of course, to all mixing devices.

Solid granular or particulate material of any suitable form may be used as the packing in a premixing device and the following are examples of suitable materials: gravel; beads, particulates, rods, spheres, tubular sections, blocks of metal, glass, ceramic or other solid materials, and Raschig rings.

Systems including a premixing device preferably include means for injecting the foaming agent into the device through one or more orifices whose dimensions may be adjusted to suit the premixing device and other conditions of use. Such injection devices may have simple orifices or may themselves incorporate nozzles affording enhanced shearing action.

An exemplary injection arrangement is shown in FIG. 10 which illustrates part of a circuit similar to that shown in FIG. 5. The asphalt and by-pass lines 20 and 22 are connected through valve 21, and the water line 23 is connected in the feed line 43 to the nozzle 15 by means of an injection device 44. The premixing device 32 is located intermediate the nozzle 15 and the injection device 44, and it is preferred to locate the device 32 and nozzle 15 close together so as to minimize cooling problems or difficulties with vapor separation and premature foam formation and decay, (these, in turn, may impose a need for higher operating pressures to restrict vaporization). Nevertheless, there are circumstances where it may be desired to separate the discharge orifice or orifices in a single foam generating system by a considerable distance from the injection device 44 or premixing device 32, if the latter is used, and the conditions of operation can be readily adjusted to enable satisfactory performance under such circumstances. The injection device 44 preferably has a comparatively small outlet orifice 45 (e.g., in the case of a 0.25 inch diameter water line, an injection orifice of 0.018 inch was found suitable).

Figure 11:
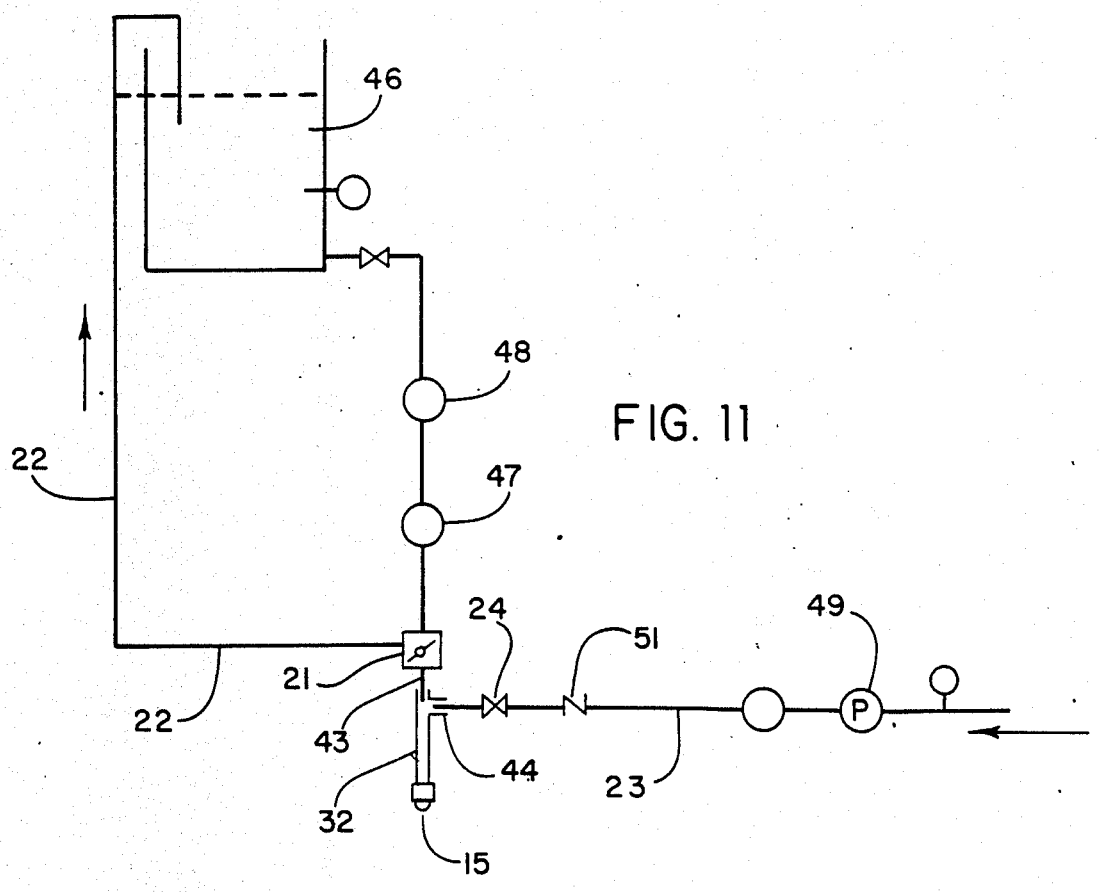
FIG. 11 is a diagram of a foam-generating system of which FIG. 10 may form part.

A complete circuit of which FIG. 10 may form part is shown diagrammatically in FIG. 11. The asphalt line 22 is connected to a reservoir 46 through a pump 48, which is preferably operated through a variable speed drive. A pressure gauge 47 is also included in line 22. The water line 23 includes a pump 49 and is preferably connected to the injection device 44 via metering valve 24 and a non-return valve 51.

FIG. 12 shows part of a system similar to FIG. 10, but in which a spray bar 52 is substituted for nozzle 15. Spray bar 52 has a number of apertures or nipples 53, each of which serves as a discharge orifice. Spray bar 52 is positioned to provide a coating 54 on a sheet member 55 such as a carpet. A heated doctor blade 56 may be used to smooth and spread the applied coating 54. It has been found that a premixing device 32 as shown in FIG. 9 is particularly satisfactory for use with spray bars.

The only premixing devices so far described are those of the static type, but such devices may also include a movable mixing element. FIG. 15 shows a premixing device 32 which includes a rotatable propellor 57 located between the injection device 44 and the nozzle 15. In practice, such a propeller device 32 has been coupled to a 220 rpm electric motor and operated to produce excellent asphalt foams when used in association with various nozzles. It is possible to use such a device 32 without a dispensing or foam generating nozzle, although a simple orifice is generally necessary for directional control of the foam and such other control as may be required.

Other movable element devices are possible. For example, the device may include a non-rotatable mechanical element, or it may take the form of a high frequency vibration generator.

Although generally more expensive than static premixing devices, premixing devices having a movable element may be of advantage in some circumstances such as where low resistance is desirable, or where there is a need for simple means to change the dispersing action to suit different materials or other operating conditions. This can be achieved by means of a variable speed drive for the movable element.

The foam generating device should be selected in accordance with the operating conditions, including the viscosity of the asphalt being foamed. To illustrate this, with special reference to viscosity, a sample of 90 penetration asphalt having a viscosity of 140 cp at 320° F. was fluxed with increasing increments of a heavy black oil (210 SUS at 210° F.). These samples were foamed at 320° F. by injecting 1% of water through a water injection device as shown in FIG. 10, premixing in a Raschig ring device as shown in FIG. 9, and discharging in different experiments through both the low shear and tangential entry nozzles. Both types of nozzles produced excellent foam from the unfluxed bitumen not only with respect to volumetric expansion (typically 19:1) but also in producing such foam instantaneously upon exit from the nozzle. However, as the viscosity was decreased by fluxing, the simple low shear nozzle failed to produce a completely instantaneous foam from a sample reduced to a viscosity of 36 cp at 320° F. Substitution of the higher shear tangential entry nozzle such as shown in FIGS. 3 and 4 resulted in instantaneous foam generation and this property was retained down to the concluding viscosity in these tests of 12 cp at 320° F. The probable explanation of this is that the shearing of water into suitable sized droplets depends in part on the viscosity of the liquid asphalt and this action becomes less severe as viscosity is reduced.

Circumstances may be encountered where it is desired to dispense a foamed material to a number of locations without providing foam generating units at each of such locations. The foam spray bar (FIG. 12) will cope with many such situations. Other situations may arise where it is desired to distribute foamed materials or latent foams to one or more discharge orifices located in difficultly accessible places or at considerable distances from the point at which water is injected and mixed with the asphalt. This can be achieved with suitable selection of equipment and procedures provided means are incorporated for preventing undue cooling of the materials.

For example, with an injection device 44 as shown in FIG. 10, coupled with a Raschig ring premixing device as shown in FIG. 9, excellent asphalt foam was obtained from the open end of a 21 foot length of 0.5 inch pipe connected to the outlet of the premixing device 32. This pipe was heated by means of electrical tape to reduce heat losses. The asphalt temperature in one experiment was 345° F. at the inlet to the foam generating system and 295° F. at the discharge end of the heated pipe. With a water injection ratio of 1:75 a foam ratio of 17.2:1 was achieved (with Australian Standard R90 Bitumen). This system also operated satisfactorily with constricted discharge orifices and at various back pressures.

In systems such as this, some additional shearing will usually occur, or it may be deliberately provided as by the use of packings, bends, baffles, constrictions, narrow bore piping or convolutions. The extent of the shearing will determine the degree of dispersing which should be provided prior to entry of the mixture of material being foamed and the foam producing liquid into this part of the system. All these factors can be controlled, for example, with the packed premixing devices by simply adding or subtracting Raschig rings or other packing materials; alternatively, the orifice diameter of the water injection system may be varied.

In these elongated distribution systems it is also possible to depart from the normally preferred practice of preheating the asphalt before injecting the water to a temperature sufficient to generate the desired volume of foam. In this case, some of the heat may be added along the system after the water has been injected, particularly as some provision for heating will commonly be made to minimise line cooling.

Satisfactory foaming can be achieved without the use of dispersing action or mixing nozzles, especially when premixing devices with static or moving elements are used, for example, with a foam spray bar with plain outlet holes coupled to a premixing device.

Soluble or dispersible additives may be incorporated in the liquid foaming agent to impart desired characteristics to the foam or to the final coating. For example, such an additive may be a surface active material for promoting adhesion of the asphalt to soil or aggregate particles.

In describing the method it has been said that the foaming occurs "during discharge of the base material-volatile agent mix through the discharge orifice" or "as the base material-volatile agent mix emerges from the discharge orifice". Those and similar statements should be interpreted broadly because experiments have not conclusively established the exact time at which foaming commences. At least some of the foaming occurs at the moment of release from the discharge orifice, but it is possible that some foaming actually occurs within the orifice and even within the mixing chamber (or other surrounding body such as conduit) before actual entry into the discharge orifice.

The foamed asphalt will normally be applied immediately to the aggregate (or other substrate) immediately, while the foam structure still persists. As shown in FIG. 12, the foam can then be spread evenly over the substrate. In the case of aggregates, the foam can be mixed in by suitable mixing devices such as a paddle mixer. The coated aggregates prepared by this method are exceptionally good in their properties, having distribution of coating which leads to excellent road building characteristic. Furthermore, the aggregates can be coated in this way, even when they are cold and moist. In addition, relatively smaller amounts of asphalt can be used, if desired, because the use of the foam technique enables the asphalt to be spread more efficiently; there is therefore a lesser need to provide excess asphalt to ensure that the aggregate is completely coated.

Since the process vaporizes the liquid foaming agent by direct contact with the hot asphalt, the heat transfer is extremely efficient and this means that further economic advantages are obtained because the costs of raising steam can be avoided. In addition, the relatively higher costs of asphalt cutbacks can be avoided because the present process enables the asphalt to be mixed in with the aggregate on its own without the need for cutback diluents.

In order that the invention may be more fully understood, the following Examples are given by way of illustration only.

EXAMPLE 1

In this experiment, saturated steam was supplied to a conventional nozzle as previously described (with reference to FIG. 1) which was connected to a reservoir of heated asphalt held at a temperature of 320°±15° F. This asphalt was a 90 penetration paving grade asphalt manufactured by blowing a petroleum residual oil, and complied with "Australian Standard A10-1967 Class R90 Bitumen".

Provision was made to introduce hot water from the steam generator into the steam line at a convenient point.

The conditions of the experiment and the nature of the foams produced are set out in Table 1 below.

TABLE 1

| Operating Variables | Steam Alone | Water and Steam |
|---|---|---|
| Steam | | |
| Pressure at nozzle, psig | 30 | 30 |
| Temperature (estimated from Steam Tables) °F. | 274 | 274 |
| Flow rate, liters/minute at STP | 41 | 41 |
| Flow rate, grams/minute | 32 | 32 |
| Water | | |
| Injection temperature °F. | — | 274 |
| Flow rate, grams/minute | — | 35 |
| Asphalt | | |
| Flow rate, grams/minute | 2500 | 2500 |
| Volumetric ratio - steam:asphalt at 30 psig | 5.5:1 | 5.5:1 |
| Weight ratio water:asphalt | — | 1:71 |
| Foam | | |
| Time to fill 2700 ml vessel, secs. | 35 | 3.5 |
| Weight of 2700 ml of foam, grams | 1450 | 161 |
| Volume per gram of bitumen, ml | 1.9 | 16.8 |
| Temperature of foam in vessel, °F. | 285 | 277 |

It will be seen in this example that a very poor foam:asphalt volume ratio was obtained when using steam alone. Its characteristics were such that it was not possible to mix it effectively with soil. On the other hand, a very high volume ratio was obtained when water was used as the primary foaming agent. This foam developed instantaneously on discharge from the nozzle and was typical of foams which can be mixed readily with soils.

EXAMPLE 2

In this experiment the same equipment and materials were used as in Example 1, but higher water and steam flow ratios relative to bitumen were employed.

In addition, the ability of the foams to mix with soil was evaluated as an indication of their suitability for commercial use. For this purpose, a soil sample was selected at random from a large collection of soils of the kinds used for sub-base road construction and requiring stabilization. This soil had the following characteristics:

| Description | | | | | | Sand |
|---|---|---|---|---|---|---|
| Organic content % | | | | | | 0.24 |
| Modified A.A.S.H.O. Compaction* | | | | | | |
| Optimum Moisture Content % | | | | | | 12 |
| Maximum Dry Density, lb/cubic foot | | | | | | 112 |
| Grading | | | | | | |
| Sieve size | 14 | 25 | 36 | 52 | 100 | 200 |
| % Passing | 100 | 95 | 86 | 69 | 31 | 8 |

Note
*Moisture-Density Relations of Soil - Cement Mixtures [American Association of State Highway Officials (A.A.S.H.O.) T 134-6T, Corresponds to ASTM D 588-57]

Prior to use the soil was adjusted to 10% moisture content on a dry basis, this being within the optimum range for foam treatment for this particular material.

Mixing was carried out in a 10 quart dough mixer with a vertical planetary paddle. This equipment has been proven to be capable of correlating with full scale commercial mixing devices.

For the purpose of visual assessments of mixing efficiency a rating scale was used which correlates with behavior of soil mixtures after consolidation and aging. This rating scale is as follows:

| Rating | Description of Mixed Materials |
|---|---|
| 1 | No mixing, all asphalt in large lumps |
| 3 | Partial mixing, about 70% of asphalt in small balls |
| 5 | Partial mixing, about 50% of asphalt in small balls or particles |
| 7 | About 10-20% asphalt as free particles but otherwise well mixed |
| 9 | About 5% asphalt as free particles, otherwise well mixed |
| 10 | Completely mixed with no evidence of free asphalt |

On this rating scale economic asphalt utilisation and good quality mixes correspond to ratings 7 to 10. Ratings of 5 or less represent mixes with unsatisfactory properties or uneconomic utilisation of the applied asphalt. Mixes with a rating of 5 can show satisfactory soil stabilisation provided a sufficiently high dosage of bitumen is applied, but the economics of such a procedure are poor compared with mixes rating 7 or higher.

Table 2 below gives the experimental conditions and results obtained and it will be seen that the use of high steam ratios relative to bitumen in the absence of water, does not obviate the deficiencies in foam volume ratio shown in Example 1. On the other hand, the use of water again produced an excellent, instantaneous, high volume ratio foam. No great advantage in the latter case is shown for appreciable excess of water over that theoretically needed for the foam volume obtained.

When mixed with the soil samples, the required mix quality was not obtained in the experiment conducted without water whereas the high volume ratio foam obtained with water injection produced a very satisfactory mix and represents effective utilisation of the applied amount of asphalt.

TABLE 2

| Operating Variables | Steam Alone | Water and Steam |
|---|---|---|
| Steam | | |
| Pressure at nozzle, psig | 30 | 30 |
| Temperature (estimated from Steam Tables) °F. | 274 | 274 |
| Temperature of steam or water and steam at 0.5 inch from nozzle outlet in absence of asphalt flow °F. | 180 | 180 |
| Flow rate, liters/minute at S.T.P. | 250 | 250 |
| Flow rate, grams/minute | 200 | 200 |
| Water | | |
| Injection temperature °F. | — | 274 |
| Flow rate, grams/minute | — | 140 |
| Asphalt | | |
| Flow rate, grams/minute | 2500 | 2500 |
| Weight ratio steam:asphalt | 1:12.5 | 1:12.5 |
| Volumetric ratio steam:asphalt (at 30 psig) | 33:1 | 33:1 |
| Weight ratio water:asphalt | — | 1:17.9 |
| Foam | | |
| Time to fill 2700 ml vessel, secs. | 30 | 3.5 |
| Weight of 2700 ml of foam, grams | 1370 | 153 |
| Volume per gram of asphalt, ml | 2.0 | 17.7 |
| Temperature of foam in vessel, °F. | 280 | 250 |
| Half life of foam, mins. | — | 1 |
| Soil Mixture | | |
| Appearance | Much free asphalt | Asphalt well mixed |
| Rating | 5 | 8 |
| Bitumen Content, % | 3.5 | 3.5 |

EXAMPLE 3

This experiment was designed to compare the effects of replacing steam by compressed air under conditions generally similar to those used in Example 2. In this case air at 30 psig and ambient temperature was applied to the nozzle in place of steam, and provision was made for introducing a controlled amount of water at ambient temperature into the air stream.

It was found that the conventional nozzle described is prone to blockage with solidifed asphalt when using cold gases and water, and consequently the modified nozzle (FIG. 2) was employed in this experiment. The modified nozzle avoids the relatively long asphalt passage as used in the former nozzle thereby reducing the chilling of the asphalt.

The conditions used and results obtained in this experiment are summarised in Table 3 below. It will be seen that the use of a compressed gas alone gave poor foam production just as in the case of steam. This confirms that it is not practicable to mix into the asphalt the volume of gas or vapor needed for high foam ratios.

On the other hand, when water was used as the primary foaming agent an excellent high volume ratio foam was obtained giving a satisfactory soil mix in contrast to the foam made from air alone, or from steam alone, as in Example 2.

TABLE 3

| Operating Variables | Compressed Air Alone | Water and Compressed Air |
|---|---|---|
| Air | | |
| Pressure at nozzle, psig | 30 | 30 |
| Temperature at nozzle, °F. | 78 | 78 |
| Temperature of air or air & water at 0.5 inch from nozzle outlet in absence of asphalt flow | 70 | 65 |
| Flow rate, liters/minute at S.T.P. | 210 | 210 |
| Water | | |
| Injection Temperature °F. | — | 65 |
| Flow rate, grams/minute | — | 120 |
| Asphalt | | |
| Flow rate, grams/minute | 2500 | 2500 |
| Volumetric ratio air:asphalt at 30 psig | 28:1 | 28:1 |
| Weight ratio water:asphalt | — | 1:20.8 |
| Foam | | |
| Time to fill 2700 ml vessel, secs. | 40 | 3.5 |
| Weight of 2700 ml of foam, grams | 1900 | 131 |
| Volume per gram of asphalt, ml | 1.4 | 20.6 |
| Temperature of foam in vessel, °F. | 285 | 255 |
| Half life of foam, mins. | — | 1.5 |
| Soil Mixture | | |
| Appearance | Considerable free asphalt Particles | Satisfactory dispersion of asphalt |
| Rating | 4 | 7 |
| Asphalt content % | 3.5 | 3.8 |

EXAMPLE 4

This example is designed to show the soil stabilisation benefits obtained when using a highly expanded asphalt foam. Comparisons are made with untreated soil, and soil treated according to the prior art using saturated steam to produce the foam.

The equipment used for the latter method of producing foam by using saturated steam alone was the same as that described in Example 2.

The equipment used for generating foam with water as the foaming agent was a combination of devices already described. These consisted firstly of a 0.018 inch diameter orifice for injecting water into the hot asphalt stream, followed by a Raschig ring premixing device, and terminating in a simple discharge nozzle with no internal shearing devices and having a lip-shaped exit slit. The ratio of water to asphalt was 1:100 and the asphalt temperature 330° F.

The system using saturated steam alone gave poor foam expansion of 2 volumes per unit weight of asphalt; however the steam flow appeared to cause substantial atomisation which was of assistance in mixing the asphalt into the soil.

The system using water as the foaming medium produced an expansion to 18 volumes of foam per unit weight of asphalt.

Road paving asphalt of 90 penetration meeting Australian Standard A10-1967 was used in these experiments.

The soil used was a composite sample of prior stream sand deposits consisting mainly of clean fine sand of maximum size of ⅜ inch to 3/16 inch, uniformly mixed with a proportion of overburden loam or clay to improve the cohesion of the material for roadmaking purposes.

A typical sieve analysis was as follows:

| B.S. Sieve No. | ⅜ | 3/16 | 7 | 14 | 25 | 36 | 52 | 100 | 200 |
|---|---|---|---|---|---|---|---|---|---|
| % Passing | 100 | 99 | 93 | 75 | 39 | 25 | 17 | 10 | 5 |

The Plasticity Index of the soil was 5 and under the Unified Soil Classification system (Corps of Engineers, U.S. Army, Technical Memorandum No. 3-357, Vols. 1 and 3, March 1953) would be categorised SP-SC for field identification.

The modified A.A.S.H.O. optimum moisture content of the untreated soil was 8%.

The determined "fluff-point" of the soil was approximately 6% moisture and foam mixing was carried out at 6.3% moisture. Compaction with 2.8% R90 asphalt present was carried out at 6.3% moisture content.

For the purpose of these experiments 4800 gms of soil of known moisture content was placed into the mixer and with the paddle operating at constant speed of approx. 50 rpm sufficient water was added to raise the moisture level of the aoil to the "fluff-point". The latter is that point at which the soil is at its greatest volume per unit weight and which has been found to be optimum for foam dispersion which in this case was at 6.3% moisture. After thorough mixing, 2.8% asphalt was introduced after foaming into the soil at ambient temperature, whilst continually mixing.

The asphalt and soil mixture was visually examined on completion of mixing for asphalt coating efficiency and was rated on the arbitrary numerical scale referred to in Example 2. The sample prepared with saturated steam had a poor rating of 5 on this scale whereas that using water as the foaming agent was rated at 8.

The treated soil was then transferred to plastic bags which were sealed and stored overnight prior to compaction of specimens the following day.

For compaction the treated soils were first brought to the Optimum Moisture Content (OMC) which is that moisture level at which maximum dry density is achieved under compaction. Compaction of the materials was carried out at "OMC" and ambient temperature (65° F. to 75° F.) using a Californian Kneading Compactor with a "foot" pressure of 350 psi. General procedures for compaction are those described in Californian Division of Highways, Test Method Number 301F (Part 11, 1964).

Four specimens were prepared, their height, weight and density being calculated at this stage. Specimens for most of the tests require dimensions of 4 inches diameter and 2.5 inches high.

The specimens contained within their respective moulds were then placed in an oven maintained at 140±5° F. for a period of 3 days to reduce the moisture to an equilibrium level which is considered from experience to conform to field conditions.

Each of the cured specimens was subjected to a variety of tests, based mainly on Standard Procedures of the Californian Division of Highways and/or ASTM. These tests are listed below:

(1) Modified Resistance Value—Before and after Soak Test. A Modified Resistance Value is determined on a cured out specimen at ambient temperature using the standard procedure of Method No. 301 (Part V) of the Californian Highways. On completion of the test the specimen is reinserted in its mould, weighed and then immersed in water at 70° F. for a period of four days. After re-weighing the Resistance Value is re-determined.

(2) Relative Stability Value—Before and after Moisture Vapor Susceptibility (MVS) Test.

The relative Stability Value is determined on a cured out specimen at 140° F. using the standard procedure of Method No. 304E (Part 111 1966) of the Californian Highways, or ASTM D-1560.

A further specimen is subjected to Moisture Vapor Susceptibility using procedures described in Method No. 307D of the Californian Highways and subsequent to determining the amount of water absorbed, the Relative Stability is determined.

(3) Strength Tests—Cohesiometer Value and Unconfined Compressive Strength. The Cohesiometer value according to Californian Test Method No. 306B or ASTM D1560 is determined on a cured specimen at 140° F. and also on a specimen previously subjected to the MVS test.

Unconfined Compression Strength is determined by application of a load at a rate of 0.05 inch per minute on a cured specimen and on one previously subjected to the four day Soak Test.

(4) Water Absorption

The amount of swelling of a cured specimen is determined according to Californian Method No. 305B and the Permeability is recorded. Moisture absorbed in the MVS and Soak Test is recorded.

(5) Marshall Testing

In addition to the preceding tasts the Marshall Stability of a specimen is determined either in a dry state or after four days water immersion. In the work results quoted herein the Marshall Stability has been determined on a specimen compacted by means of the Californian Kneading Compactor (as previously described) and then subjected to three days curing at 140° F. The actual procedure used in testing the specimen conforms to ASTM Test Method D1559-65. The results of these tests are shown in Table 4 below.

TABLE 4

| Test | No Asphalt | Saturated Steam Process | Water Process |
|---|---|---|---|
| Average new weight 3 test briquettes (grams) | 1126 | 1118 | 1146 |
| Average new height 3 test briquettes (inches) | 2.52 | 2.49 | 2.51 |
| Average new density 3 test briquettes (lbs./cft.) | 127 | 128 | 130 |
| Average weight cured to equil. moisture 3 days at 140° F. | 1072 | 1072 | 1098 |
| Average moisture content after curing % | 1.6 | 2.3 | 2.1 |
| Resistance values before & after Soak Test (Ambient Temp) | | | |
| Stabilometer PH at 1000 lbs | 5, * | 5, 14 | 5, 10 |
| Stabilometer PH at 2000 lbs | 7, * | 6, 27 | 5, 18 |
| Displacement, turns | 5.68, * | 3.08, 4.05 | 3.38, 4.0 |
| R-Value | 90, * | 95, 75 | 96, 83 |
| Relative Stability Values before & after MVS test at 140° F. | | | |
| Stabilometer PH at 1000 lbs | 6, 12 | 5, 17 | 5, 8 |
| Stabilometer PH at 2000 lbs | 8, 24 | 7, 28 | 6, 12 |
| Stabilometer PH at 3000 lbs | 13, 39 | 10, 39 | 8, 18 |
| Stabilometer PH at 4000 lbs | 18, 60 | 14, 52 | 11, 26 |
| Stabilometer PH at 5000 lbs | 25, 82 | 23, 66 | 15, 37 |
| Displacement - turns | 5.08, 4.06 | 3.55, 4.43 | 3.10, 2.85 |
| Relative Stability | 40, 18 | 51, 20 | 64, 43 |
| Strength Tests | | | |
| Cohesiometer Value | 277, ** | 509, 48 | 709, 387 |
| Unconfined Compressive Strength - psig | 268, * | 648, 64 | 816, 144 |
| Water Absorption Data | | | |
| Swell - inches | 0.019 | 0.017 | 0.003 |
| Permeability - mls | 500 | 450 | 210 |
| Moisture Absorbed in soak test - grams | — | 58 | 27 |
| Moisture Absorbed in soak test - % | — | 5.4 | 2.4 |
| Moisture Absorbed in MVS test - grams | 81 | 60 | 19 |
| Moisture Absorbed in MVS test - % | 7.6 | 5.6 | 1.7 |
| Marshall Test Data | | | |
| Maximum Load (corrected) - lbs | 4425 | 5000 | 6080 |
| Flow value - inches | 0.064 | 0.063 | 0.050 |
| Moisture Content - % | 1.2 | 1.6 | 1.3 |

* Specimen collapsed after soak test
** Specimen subjected to MVS test collapsed From the results it may be concluded that the use of highly expanded foams produced from water only produces soil mixtures with much improved properties over those produced from the saturated steam process even though this shows noticeable improvement over untreated soil. The following more detailed comparisons may be made between the two asphalt treatments.

Density—The average dry density of four specimens produced from each respective sample mix increased from 127 lbs/cu. ft. for the untreated soil to 128 lbs/cu.ft. for the steam process to 130 lbs/cu.ft. for the water process. These results illustrate the benefit of improved coating with the better type foam.

Modified Resistance Values—In a relatively dry cured state all specimens show good figures, however, after four days water soaking the untreated soil collapsed on removal from the mould. A significant improvement is shown for the water process.

Modified Relative Stability—Very good figures were obtained in a cured state, again the water process being significantly better. After MVS test a remarkable retention of strength was evident for the water process. The untreated sample and saturated steam foamed sample showed a large decrease.

Swell Test—The water process showed a particularly low result, whilst the other two were higher and showed little difference indicating the ineffectiveness of asphalt dispersion and "fines" coverage with saturated steam.

Cohesiometer Value—Here again the water process showed superior results in a cured condition and also a particularly high percentage retention after MVS testing.

Unconfined Compressive Strength—Similar respective results were obtained.

Permeability—The water process gave a much lower permeability than either of the others, again indicating the benefits of improved dispersion.

EXAMPLE 5

This example demonstrates the use of an inverted emulsion as the foaming agent.

Two emulsions were prepared using a naphthenic mineral lubricating oil (100 SUS at 100° F.). Emulsion No. 1 contained 54.7% by weight of this oil with an emulsifier system comprising 0.8% potassium naphthenate and 1.45% sodium petroleum sulphonates on a pure basis. Emulsification with water was completed through a commercial homogeniser of the high pressure restricted orifice type to give an average particle diameter of 2 to 3 microns.

Emulsion No. 2 was designed to have a coarser particle size and was prepared from 55% by weight of a similar lubricating oil to that used in Emulsion No. 1, with 2% of glycerol monooleate as emulsifier. Emulsification was achieved by high speed stirring giving a dispersion with a particle size of about 15 to 20 microns.

In many combinations of nozzles, with and without premixing devices, Emulsion No. 2 provided high foam expansion ratios, i.e. of the order of 20:1, when used at an addition rate equivalent to 1 part of water to 100 parts of asphalt, the latter being at a relatively high temperature, typically 320° F.

In still another experiment with this emulsion, using a foam generating system capable of providing a foam ratio of 20:1 at an operating temperature of 325° F., the ratio dropped to 2.2:1 when the temperature was lowered to 240° F. However, by reducing the particle size of this emulsion by passing it through a high pressure homogenizer which gave an average particle size of 10 to 12 microns, the foam ratio was increased from 2.2:1 to 5.1:1.

In similar experiments with the finely dispersed Emulsion No. 1, the converse was illustrated where, in two similar experiments carried out with bitumen heated to 240° F. and 335° F., the respective foam expansions were 10:1 and 2:1. In this case it is believed, that the very fine dispersion of water vaporised prematurely at high temperature, but vaporised at a much more satisfactory rate at low temperatures, in the systems studied. This supports the propositions that it is desirable to use a dispersion device or procedure which provides an optimum degree of dispersion and which matches the remainder of the system and its operating conditions.

EXAMPLE 6

This Example illustrates further the use of an inverted emulsion to generate a high quality asphalt foam with very simple dispersing devices.

The emulsion used was the coarse particle size Emulsion No. 2 described in Example 5.

The emulsion was injected through an orifice of 0.030 inches diameter into the asphalt line immediately upstream of a discharge nozzle of the type previously described (FIG. 3) in which the asphalt enters a cylindrical chamber tangentially. No premixing device was interposed between the discharge nozzle and the emulsion injection orifice.

Operating conditions and results achieved are tabulated in Table 5 below for an experiment using asphalt conforming to Australian Standard A10-1967 Class R90.

TABLE 5

| Operating Conditions and Results | |
|---|---|
| Emulsion temperature °F. | 66 |
| Emulsion flow rate gms/min | 70 |
| Asphalt temperature °F. | 325 |
| Asphalt flow rate gms/min | 2800 |
| Weight ratio, water:asphalt | 1:93 |
| Foam volume per gram of asphalt, ml | 20.0 |

This foam had a half life of 2.5 minutes in the 2700 ml vessel used in previous examples which is similar to that obtained when foams of similar expansion were obtained from the same asphalt using water or water assisted by steam. Also, the system showed the desired characteristic of the instantaneous foam generation on discharge from the nozzle.

EXAMPLE 7

In this example the mechanical dispersing device comprising a high speed propeller inserted in the asphalt supply line between the water injector and the simple discharge nozzle previously described with reference to FIG. 13, was used to produce foam from asphalt conforming to Australian Standard A10-1967 Class R90. The nozzle used did not incorporate any shearing device other than a lip-shaped orifice 0.5 inch in length and of maximum width 0.133 inches. This nozzle was sized to discharge 4 Imperial gallons per minute of R90 asphalt at 350° F. and 12 psi, flow being axial from entry to orifice.

Table 6 below summarises performance of this sytem.

TABLE 6

| Operating Conditions and Results | |
|---|---|
| Asphalt Temperature °F. | 345 |
| Asphalt flow rate, grams/minute | 2,800 |
| Water temperature, °F. | 57 |
| Water flow rate, grams/minute | 29 |
| Ratio water:asphalt (weight of volume) | 1.97 |
| Pressure during operation psi | 12 |

TABLE 6-continued

| Operating Conditions and Results | |
|---|---|
| Foam volume per gram of asphalt, ml | 15.2 |

Foam generation on discharge was instantaneous.

EXAMPLE 8

This example illustrates the effectiveness with which foam ratio can be controlled by the means provided by this invention. Table 7 below lists the operating conditions and foam ratios obtained in a series of experiments in which the ratio of water to asphalt was varied without significant alteration of other operating factors. The previously described injection orifice and Raschig ring mixing device were used in conjunction with the axial flow, low-shear slit orifice nozzle.

TABLE 7

| | | | | | |
|---|---|---|---|---|---|
| Asphalt Temperature °F. | 350 | 340 | 345 | 350 | 345 |
| Asphalt Flow Rate gms/min. | 2800 | 2800 | 2800 | 2800 | 2800 |
| Water injection Temp. °F. | 59 | 56 | 56 | 56 | 55 |
| Water/Asphalt ratio (wt/wt) | 1:100 | 1:200 | 1:300 | 1:400 | 1:500 |
| Pressure at inlet of dispersing system, psig. | 20 | 16 | 15 | 15 | 15 |
| Foam volume cc/gm of asphalt | 18.2 | 8.0 | 6.3 | 4.1 | 3.3 |

Foam ratios are only slightly below theoretical in all cases, indicating both the efficiency of the foaming process and the high degree of control over the degree of foam expansion.

We claim:

1. A method of forming a coating of an asphaltic base material on a substrate which comprises:

(a) combining a heated, liquid asphaltic base material with a liquid foaming agent in an adiabatic dispersion zone to form a dispersion of the foaming agent and base material, wherein the heat content of the dispersion so formed is sufficient to cause vaporization of the foaming agent at atmospheric pressure, (b) discharging the dispersion from the adiabatic dispersion zone to atmospheric pressure thereby forming a foam of the base material and (c) applying the foam so formed to the substrate without substantial heating of the substrate.

2. The method of claim 1 in which the weight ratio of foaming agent to base material is from 1:5 to 1:150.

3. The method of claim 1 in which the weight ratio of foaming agent to base material is from about 1:33 to 1:150.

4. The method of claim 1 in which the weight ratio of foaming agent to base material is from about 1:50 to 1:150.

5. The method of claim 1 in which the heated, liquid asphaltic base material flows in stream to the adiabatic dispersion zone and from this zone to a point where it is discharged in a time such that the dispersed droplets are maintained in the liquid phase between the dispersion zone and the discharge point.

6. The method of claim 1 in which the foaming agent is water.

7. The method of claim 2 in which the foaming agent is water.

8. The method of claim 1 in which the asphaltic base material comprises a paving grade asphalt.

9. The method of claim 8 in which the substrate comprises an aggregate.

10. The method of claim 1 in which the foaming agent is combined with the asphaltic base material without mechanical mixing.

11. A method of forming a coating of an asphaltic base material on a substrate which comprises:

(a) combining without mechanical mixing a heated liquid asphaltic base material with a liquid foaming agent in weight ratio of about 1:33 to 1:150 of the foaming agent to the base material in an adiabatic dispersion zone to form a dispersion of the foaming agent and base material, wherein the heat content of the dispersion so formed is sufficient to cause vaporization of the foaming agent at atmospheric pressure, (b) discharging the dispersion from the adiabatic dispersion zone to atmospheric pressure thereby forming a foam of the base material and (c) applying the foam so formed to the substrate.

12. The method of claim 11 in which the weight ratio of foaming agent to base material is from about 1:50 to 1:150.

13. The method of claim 12 in which the liquid foaming agent is water.

14. The method of claim 13 in which the asphaltic base material comprises a paving grade asphalt.

15. A method of coating a substrate with asphalt comprising continuously passing a stream of hot asphalt through a dispersion zone to a second zone at ambient conditions wherein the temperature of said hot asphalt is sufficient to vaporize water at the ambient conditions of said second zone;

foaming said hot asphalt by the step consisting of directing a continuous stream of water in the liquid state into said stream of hot asphalt in said dispersion zone, to thereby form a dispersion of liquid in water in said asphalt in said dispersion zone wherein the inherent result of said continuously passing said hot asphalt to said dispersion zone and said step for foaming in that said dispersion is formed under substantially adiabatic conditions;

wherein the weight ratios of liquid to water in said dispersion ranges from 1:5 to 1:150;

whereby the stream of hot asphalt foams in said second zone; and, after foaming directly applying the foamed asphalt to a substrate in said second zone.

16. The method of claim 15, wherein said weight ratio of water to hot asphalt ranges from 1:33 to 1:150.

17. The method of claim 15 wherein the weight ratio of water to hot asphalt ranges from 1:50 to 1:150.

18. The method of claim 15, wherein the diameters of droplets of the water in said dispersion range from 0.1 to 500 microns.

19. The method of claim 15, wherein said substrate constitute aggregates used in road paving.

20. The method of claim 15, wherein the orifice of a nozzle divides said dispersion zone from said second zone.

21. A method of coating a substrate with asphalt comprising:

continuously passing a stream of hot asphalt through a dispersion zone to a second zone at ambient conditions, wherein the temperature of said hot asphalt is sufficient to vaporize water at the ambient conditions of said second zone;

foaming said hot asphalt by the step consisting of directing a continuous stream of water in the liquid state into said stream of hot asphalt in said dispersion zone, to thereby form a dispersion of liquid in water in said asphalt in said dispersion zone;

wherein the weight ratios of liquid to water in said dispersion ranges from 1:5 to 1:150; whereby the stream of hot asphalt foams in said second zone; and, after foaming, directly applying the foamed asphalt to a substrate in said second zone, wherein the inherent result of said continuously passing said hot asphalt to said dispersion zone and said step for foaming is that said dispersion is formed under substantially adiabatic conditions.

22. The method of claim 21, wherein the weight ratio of water to hot asphalt ranges from 1:50 to 1:150.

23. The method of claim 21, wherein the substrate constitute aggregates used in road paving.

24. The method of claim 21, wherein the orifice of a nozzle divides said dispersion zone from said second zone.

* * * * *